US007042274B2

(12) United States Patent
Hazucha et al.

(10) Patent No.: US 7,042,274 B2
(45) Date of Patent: May 9, 2006

(54) REGULATED SLEEP TRANSISTOR APPARATUS, METHOD, AND SYSTEM

(75) Inventors: Peter Hazucha, Beaverton, OR (US); Tanay Karnik, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/673,822

(22) Filed: Sep. 29, 2003

(65) Prior Publication Data

US 2005/0068015 A1 Mar. 31, 2005

(51) Int. Cl.

| | |
|---|---|
| ***G05F 1/40*** | (2006.01) |
| ***G05F 1/44*** | (2006.01) |
| *G05F 1/56* | (2006.01) |

(52) U.S. Cl. ..... 327/534; 327/537; 323/274

(58) Field of Classification Search ..... 323/272, 323/273, 274; 327/534, 537, 530

See application file for complete search history.

(56) References Cited

U.S. PATENT DOCUMENTS

| | | | | |
|---|---|---|---|---|
| 5,955,910 | A * | 9/1999 | Levin et al. | 327/393 |
| 6,384,674 | B1 * | 5/2002 | Tanizaki et al. | 327/544 |
| 6,744,301 | B1 * | 6/2004 | Tschanz et al. | 327/534 |
| 6,765,414 | B1 * | 7/2004 | Keshavarzi et al. | 326/93 |

* cited by examiner

*Primary Examiner*—Bao Q. Vu
(74) *Attorney, Agent, or Firm*—LeMoine Patent Services, PLLC

(57) ABSTRACT

A transistor may operate as a sleep transistor or as a regulator.

25 Claims, 9 Drawing Sheets

REGULATED SLEEP TRANSISTOR APPARATUS, METHOD, AND SYSTEM

FIELD

The present invention relates generally to electronic circuits, and more specifically to the use of sleep transistors in electronic circuits.

BACKGROUND

Sleep transistors have been used to control leakage power in electronic circuits. They are typically coupled in a power supply current path, and are turned off when the electronic circuit is not needed. Sleep transistors are typically sized large to reduce any series resistance when they are on.

DESCRIPTION OF EMBODIMENTS

Figure 1:
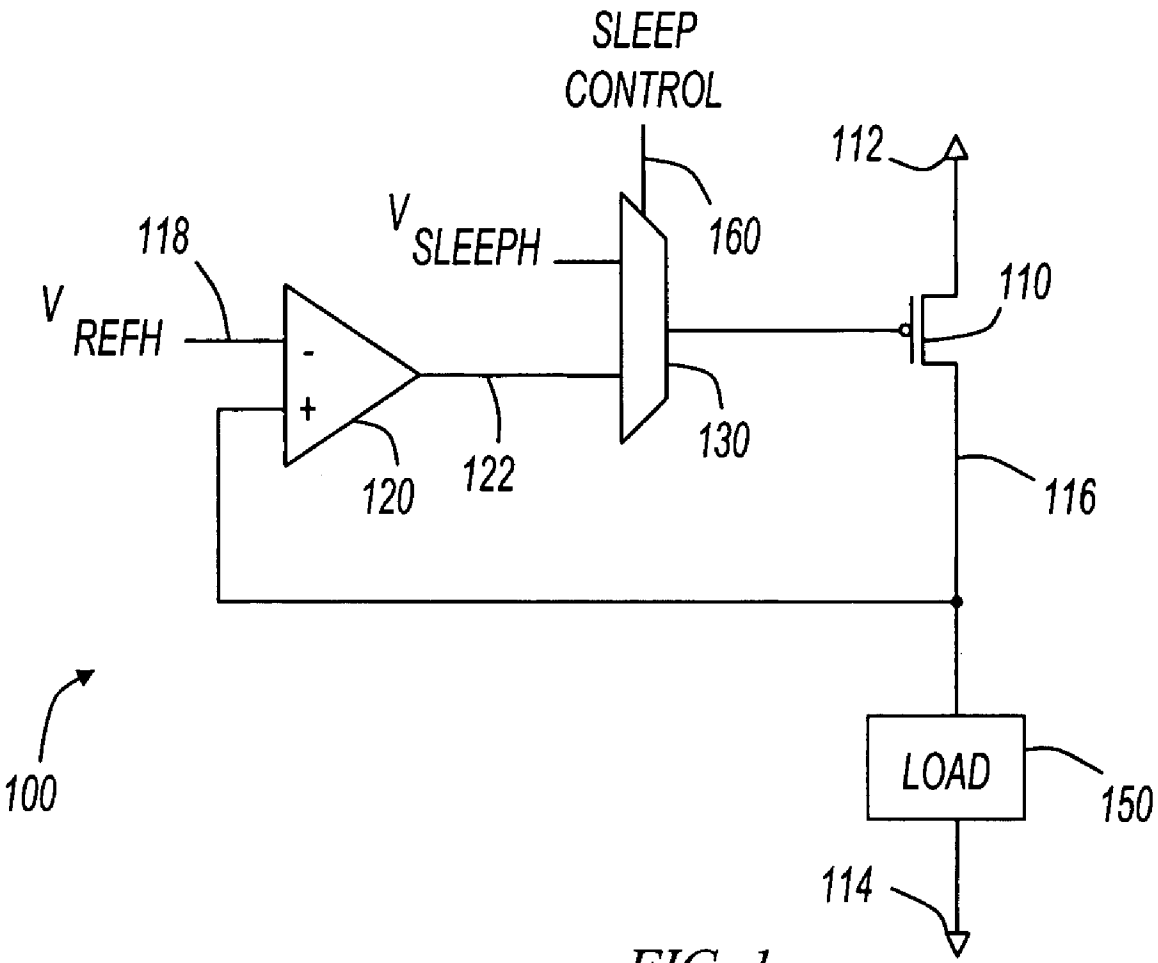
FIG. 1 shows a regulated sleep transistor circuit.

In the following detailed description, reference is made to the accompanying drawings that show, by way of illustration, various embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

FIG. 1 shows a regulated sleep transistor circuit. Circuit 100 includes transistor 110, multiplexer 130, error amplifier 120, and load circuit 150. Transistor 110 is coupled between power supply node 112 and load circuit 150. Load circuit 150 is coupled between node 116 and power supply node 114. Example embodiments of load circuit 150 include arithmetic logic units (ALU), memory circuits, cache memory circuits, communications circuits, logic circuits, or the like. The present invention is not limited in this regard; load circuit 150 may be any type of circuit. As used herein, the term "power supply node" refers to a single circuit node, and does not necessarily imply a connection between two nodes or "rails" of a power supply.

In operation, transistor 110 operates in one of two modes: sleep mode and regulator mode. When in sleep mode, transistor 110 is substantially turned off, thereby starving load circuit 150 of power supply current that would otherwise be provided by power supply node 112. When in regulator mode, transistor 110 is part of a control loop that senses the voltage on node 116 and in some embodiments, operates to keep the voltage on node 116 substantially constant.

Error amplifier 120 and multiplexer 130 are part of a control circuit adapted to utilize transistor 110 as either a regulator or a sleep transistor. Error amplifier 120 compares the voltage on node 116 with voltage $V_{REFH}$ on node 118, and provides an error signal on node 122. Multiplexer 130 selects between two voltages based on the state of the SLEEP CONTROL signal on node 160. When in sleep mode, SLEEP CONTROL selects $V_{SLEEPH}$ to drive the gate of transistor 110, and when in regulator mode, SLEEP CONTROL selects the output of error amplifier 120 to drive the gate of transistor 110.

In some embodiments of the present invention, $V_{SLEEPH}$ is a voltage that, when applied to the gate of transistor 110, will substantially turn off transistor 100. For example, the voltage difference between power supply node 112 and $V_{SLEEPH}$ may be chosen to be below the threshold voltage of transistor 110. When turned off, transistor 110 substantially starves load circuit 150 of power supply current, and reduces leakage power. $V_{SLEEPH}$ may be chosen to be substantially equal to the voltage at power supply node 112, but this is not a limitation of the present invention.

When in regulator mode, transistor 110 operates with a voltage drop between power supply node 112 and node 116. The amount of the voltage drop may vary based on many factors including the value of the reference voltage $V_{REFH}$. In some embodiments, transistor 110 may be sized smaller than prior art sleep transistors, in part because of the voltage drop across transistor 110 when in regulator mode, and because it may be used as a regulated current supply in regulator mode.

In some embodiments, $V_{REFH}$ is generated by a voltage reference circuit on the same integrated circuit die that includes circuit 100. For example, a bandgap voltage reference may be included to generate $V_{REFH}$. In other embodiments, $V_{REFH}$ is received by the integrated circuit that includes circuit 100. The present invention is not limited by the manner with which $V_{REFH}$ is generated.

In some embodiments, error amplifier 120 may be a switching amplifier. In some of these embodiments, error amplifier 120 may be turned off during sleep mode. For example, when transistor 110 is utilized as a sleep transistor and load circuit 150 turned off, error amplifier 120 may also be turned off. In other embodiments, error amplifier 120 may be a linear amplifier. Error amplifier 120 may be any type of amplifier; the present invention is not limited by the type or configuration of amplifier 120. In some embodiments, multiplexer 130 is implemented as an analog multiplexer. In other embodiments, multiplexer 130 is implemented as an amplifier that receives the error signal as an amplifier input signal, and receives SLEEP CONTROL as a control input that causes the output to settle at a static voltage level.

The control circuit that includes error amplifier 120 and multiplexer 130 may be implemented using devices other than an error amplifier and multiplexer. For example, in some embodiments, an analog to digital converter samples the voltage on node 16, and a digital control loop circuit determines the proper voltage to drive on the gate of transistor 110. A digital to analog converter then provides a voltage to drive the gate of transistor 110. The present invention is not limited by the particular arrangement of the control circuit.

Figure 2:
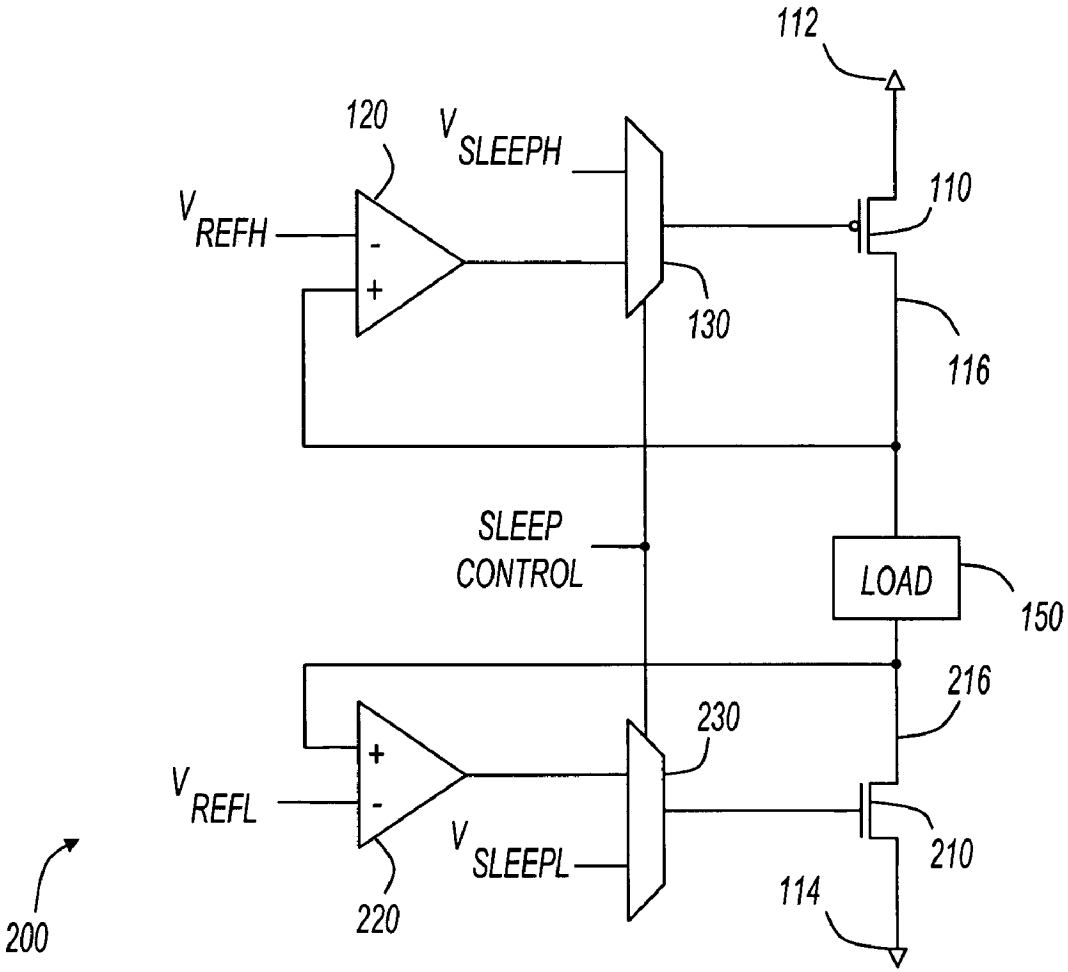
FIG. 2 shows a dual regulated sleep transistor circuit.

FIG. 2 shows a dual regulated sleep transistor circuit. Circuit 200 includes transistors 110 and 210, and load circuit 150. Transistor 110 is coupled between power supply node 112 and load circuit 150; and transistor 210 is coupled between load circuit 150 and power supply node 114. Circuit 200 also includes a control circuit that includes error amplifiers 120 and 220, and multiplexers 130 and 230. The control circuit is adapted to utilize transistors 110 and 210 as regulators or sleep transistors.

In operation, circuit 200 may operate in a sleep mode or a regulator mode. When in sleep mode, SLEEP CONTROL selects voltages $V_{SLEEPH}$ and $V_{SLEEPL}$ to drive the gates of transistors 110 and 210, respectively. In some embodiments, $V_{SLEEPH}$ and $V_{SLEEPL}$ are chosen such that when they are applied to the gates of transistors 110 and 210, the transistors are substantially turned off. When in regulator mode, transistors 110 and 210 are each part of control loops that provide power supply regulation. For example, transistor 110, error amplifier 120 and multiplexer 130 form a control loop that provides power supply regulation at node 116, and transistor 210, error amplifier 220, and multiplexer 230 form a control loop that provides power supply regulation at node 216.

In some embodiments, error amplifier 220 may be a switching amplifier. In some of these embodiments, error amplifier 220 may be turned off during sleep mode. For example, when transistor 210 is utilized as a sleep transistor and load circuit 150 turned off, error amplifier 220 may also be turned off. In other embodiments, error amplifier 220 may be a linear amplifier. Error amplifier 220 may be any type of amplifier; the present invention is not limited by the type or configuration of amplifier 220. In some embodiments, multiplexer 230 is implemented as an analog multiplexer. In other embodiments, multiplexer 230 is implemented as an amplifier that receives the error signal as an amplifier input signal, and receives SLEEP CONTROL as a control input that causes the output to settle at a static voltage level.

The control circuit that includes error amplifiers 120 and 220, and multiplexers 130 and 230 may be implemented using devices other than an error amplifiers and multiplexers. For example, in some embodiments, analog to digital converters sample the voltages on nodes 116 and 216, and digital control loop circuits determine the proper voltages to drive the gates of transistors 110 and 210. Digital to analog converters may then provide voltages to drive the gates of transistors 110 and 210. The present invention is not limited by the particular arrangement of the control circuit.

Transistors 110 and 210 are shown as isolated gate transistors, and specifically as metal oxide semiconductor field effect transistors (MOSFETs). For example, transistor 110 is shown as a P-type MOSFET (PMOSFET), and transistor 210 is shown as an N-type MOSFET (NMOSFET). Other types of switching or amplifying elements may be utilized for the various embodiments without departing from the scope of the present invention. For example, transistors 110, 210, and other transistors shown in later figures may be junction field effect transistors (JFETs), bipolar junction transistors (BJTs), or any other type of device capable of performing as described herein.

Figure 3:
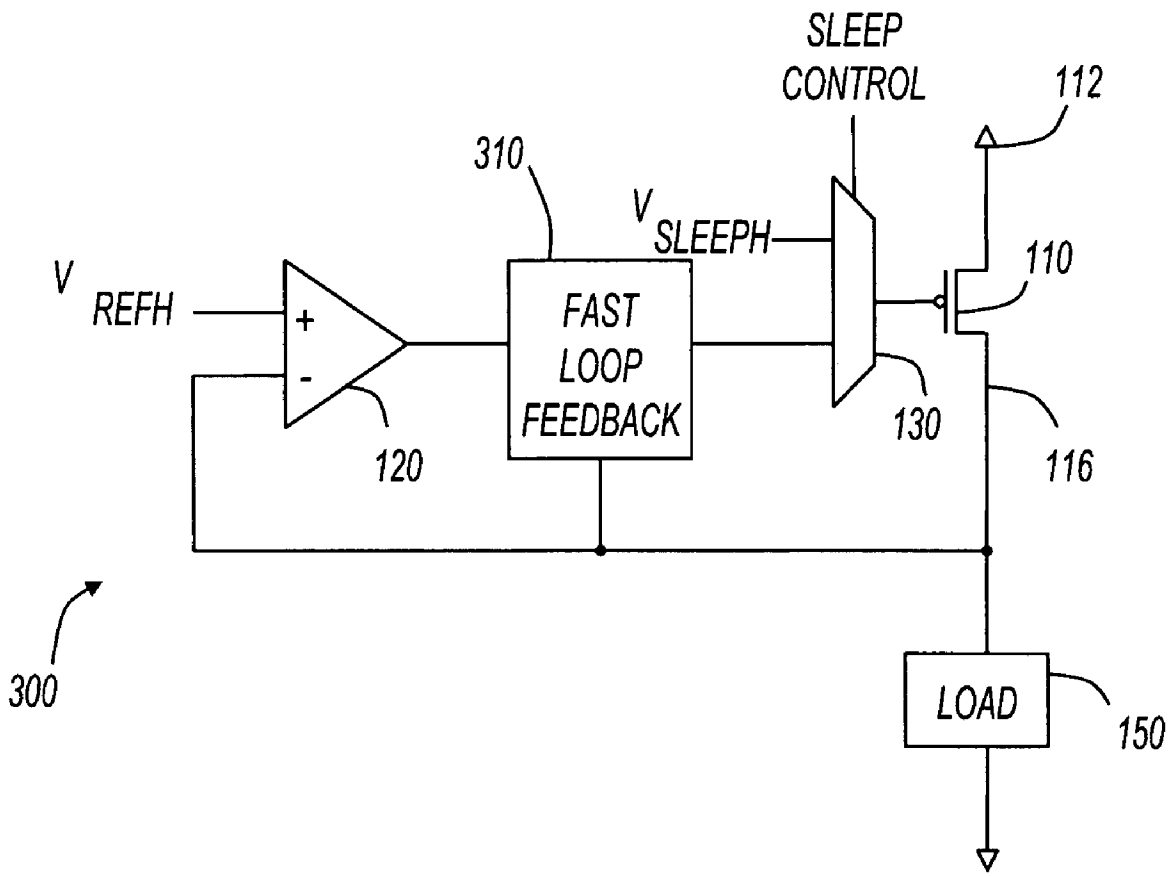
FIG. 3 shows a regulated sleep transistor circuit with multiple control loops.

FIG. 3 shows a regulated sleep transistor circuit with multiple feedback loops. Circuit 300 includes the circuitry shown in circuit 100 (FIG. 1), with the addition of fast loop feedback circuit 310. As shown in FIG. 3, circuit 300 includes two feedback loops. The first feedback loop is the same as that shown in FIG. 1; it includes transistor 110, error amplifier 120, and multiplexer 130. The second feedback loop includes transistor 110, fast loop feedback circuit 310, and multiplexer 130.

In operation, the second feedback loop has a higher bandwidth than the first feedback loop. When operating in regulator mode, the two feedback loops operate together to provide power supply regulation ("line regulation") and also provide a fast transient response ("load regulation"). For example, the operation of the first feedback loop provides a voltage on node 116 that is substantially equal to $V_{REFH}$. In some embodiments, the line regulation provided by the first feedback loop may filter input noise and compensate for process and temperature variations.

The second feedback loop may provide load regulation. For example, when load circuit 150 experiences a current transient that demands a large current, the voltage at node 116 may drop quickly. The fast loop feedback circuit may sense that the voltage at node 116 has dropped, and may provide an appropriate response to the gate of transistor 110. When there is a large load current, the voltage on node 116 drops, and the fast loop feedback circuit pulls the gate of transistor 110 low. In response, the voltage on node 116 will move back towards its original value.

Figure 4:
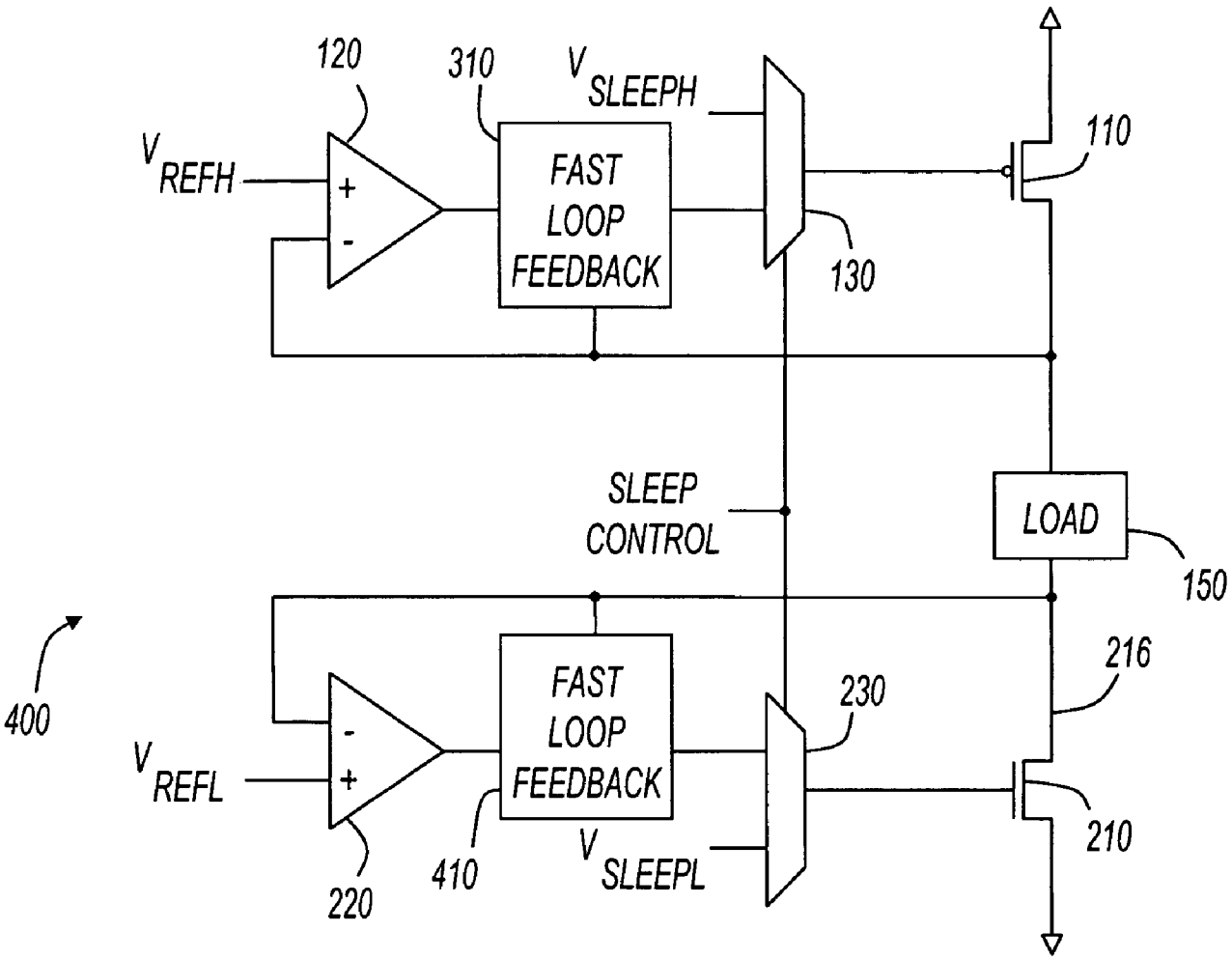
FIG. 4 shows a dual regulated sleep transistor circuit with multiple control loops.

FIG. 4 shows a dual regulated sleep transistor circuit with multiple feedback loops. Circuit 400 includes the circuitry shown in circuit 200 (FIG. 2), with the addition of fast loop feedback circuits 310 and 410. As shown in FIG. 4, circuit 400 includes two feedback loops to influence the operation of transistor 110, and two feedback loops to influence the operation of transistor 210. The two feedback loops that influence the operation of transistor 210 are similar to the two feedback loops that influence the operation of transistor 110. Fast feedback loop circuit 410 senses the voltage on node 216, and provides a fast response to transistor 210. When a voltage drop on node 216 is detected, the fast loop feedback circuit drops the voltage on the gate of transistor 210. In response, the voltage on node 216 will move back towards its original value.

Figure 5:
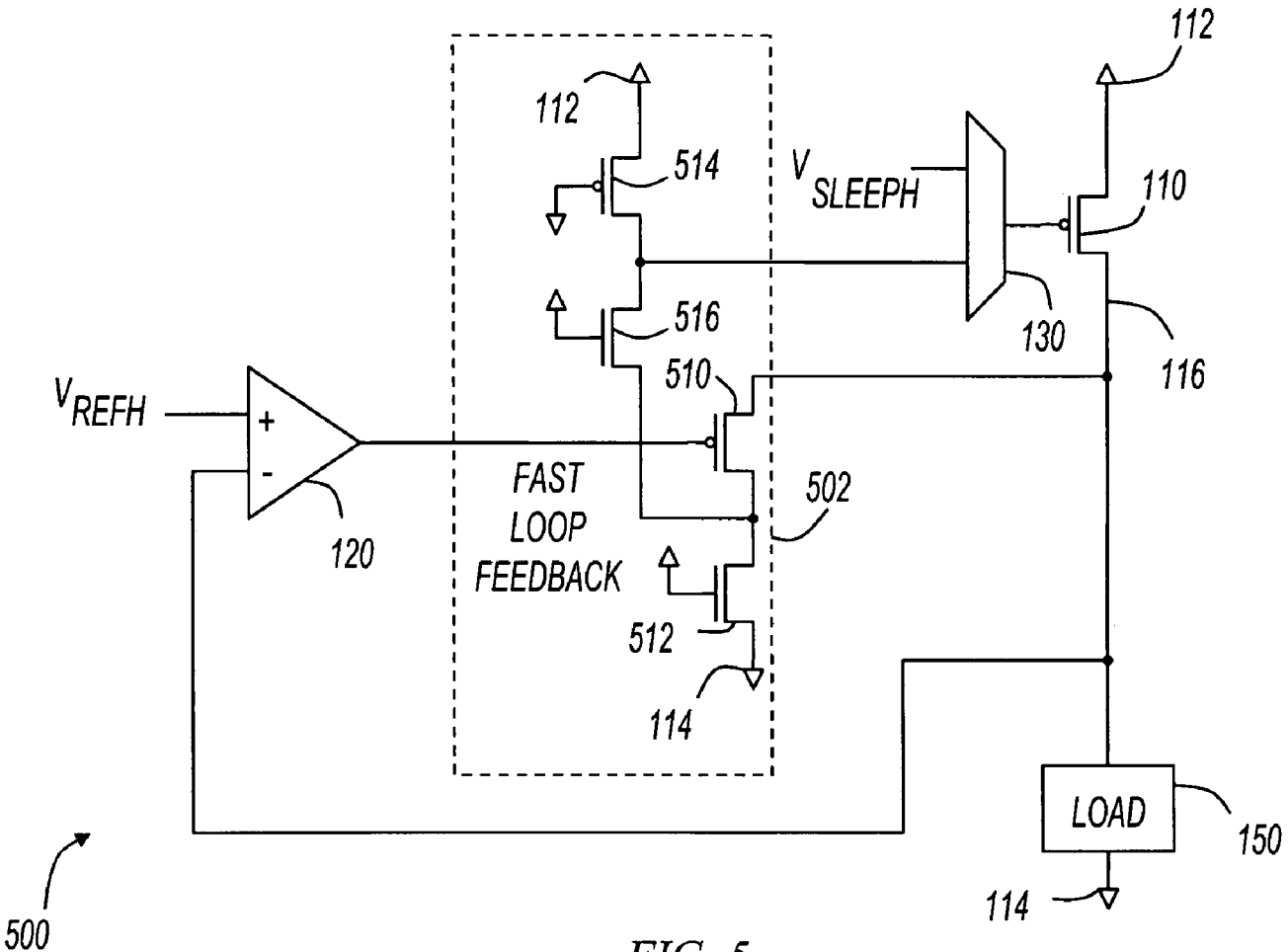
FIG. 5 shows a regulated sleep transistor circuit with a first fast loop feedback circuit in accordance with various embodiments of the present invention.

FIG. 5 shows a regulated sleep transistor circuit with a first fast loop feedback circuit in accordance with various embodiments of the present invention. Circuit 500 includes the elements shown in circuit 300 (FIG. 3), and also shows one possible implementation of a fast loop feedback circuit. For example, fast loop feedback circuit 502 may be used to implement fast loop feedback circuit 310 (FIG. 3).

Fast loop feedback circuit 502 includes transistors 510, 512, 514, and 516. Transistors 514 and 516 form a voltage divider that provides an output to influence the operation of transistor 110. Transistor 510 is a sensing transistor having a source terminal coupled to sense a voltage variation on node 116, and transistor 512 is a bias transistor.

In operation, the slower feedback loop signal path includes the gate-to-drain of transistor 510, and the source-to-drain of transistor 516. The faster feedback loop signal path includes the source-to-drain of transistor 510 and the source-to-drain of transistor 516. Transistor 510 may respond quickly to voltage variations on node 116 in part because transistor 510 is coupled to node 116 by a relatively low impedance source terminal.

Figure 6:
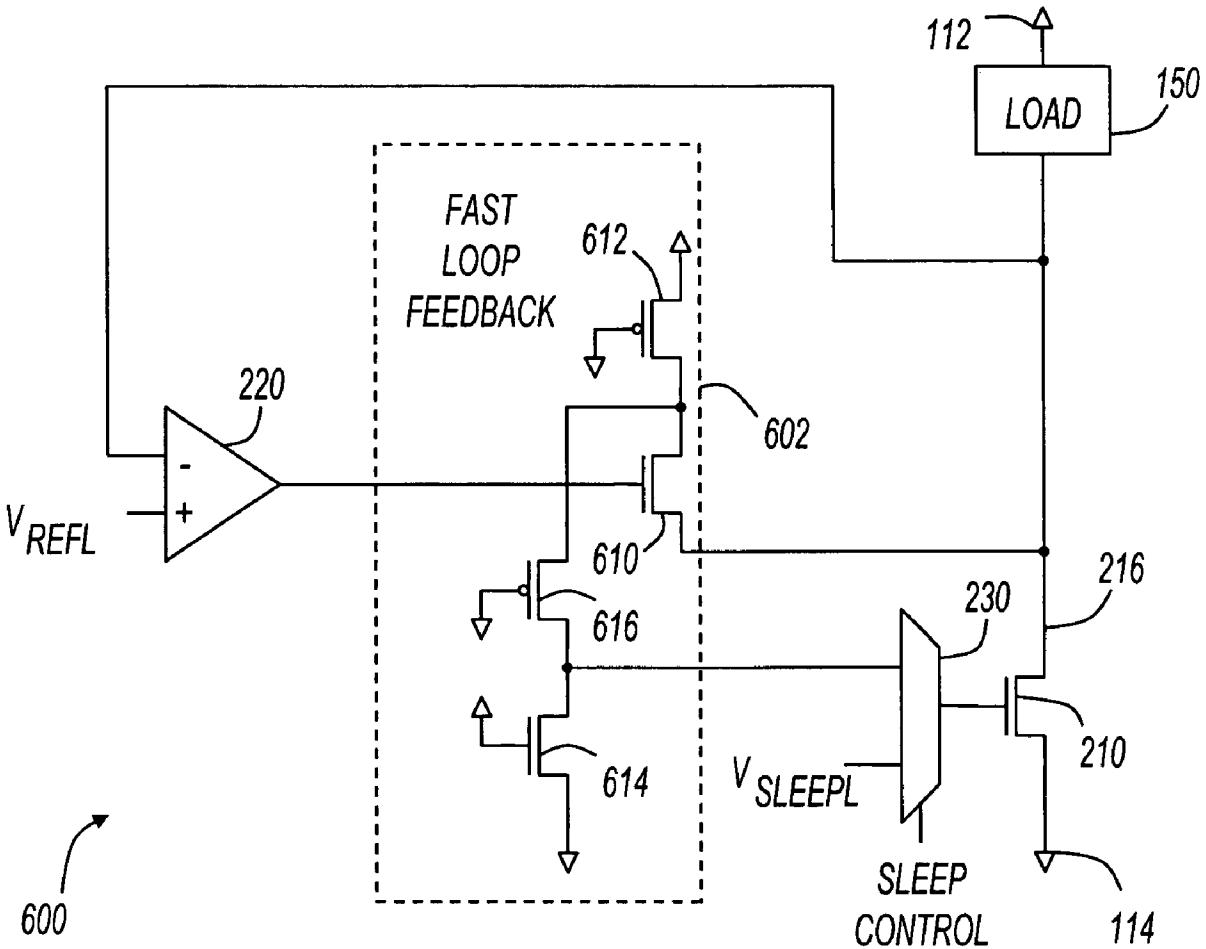
FIG. 6 shows a regulated sleep transistor circuit with a second fast loop feedback circuit in accordance with various embodiments of the present invention.

FIG. 6 shows a regulated sleep transistor circuit with a second fast loop feedback circuit in accordance with various embodiments of the present invention. Circuit 600 includes transistor 210 coupled between load circuit 150 and power supply node 114. Circuit 600 also includes error amplifier 220, multiplexer 230, and fast loop feedback circuit 602. In some embodiments, fast loop feedback circuit 602 may be utilized as fast loop feedback circuit 410 (FIG. 4).

Fast loop feedback circuit 602 includes transistors 610, 612, 614, and 616. Transistors 614 and 616 form a voltage divider that provides an output to influence the operation of transistor 210. Transistor 610 is a sensing transistor having a source terminal coupled to sense a voltage variation on node 216, and transistor 612 is a bias transistor.

In operation, the slower feedback loop signal path includes the gate-to-drain of transistor 610, and the source-to-drain of transistor 616. The faster feedback loop signal path includes the source-to-drain of transistor 610 and the source-to-drain of transistor 616. Transistor 610 may respond quickly to voltage variations on node 216 in part because transistor 610 is coupled to node 216 by a relatively low impedance source terminal.

Figure 7:
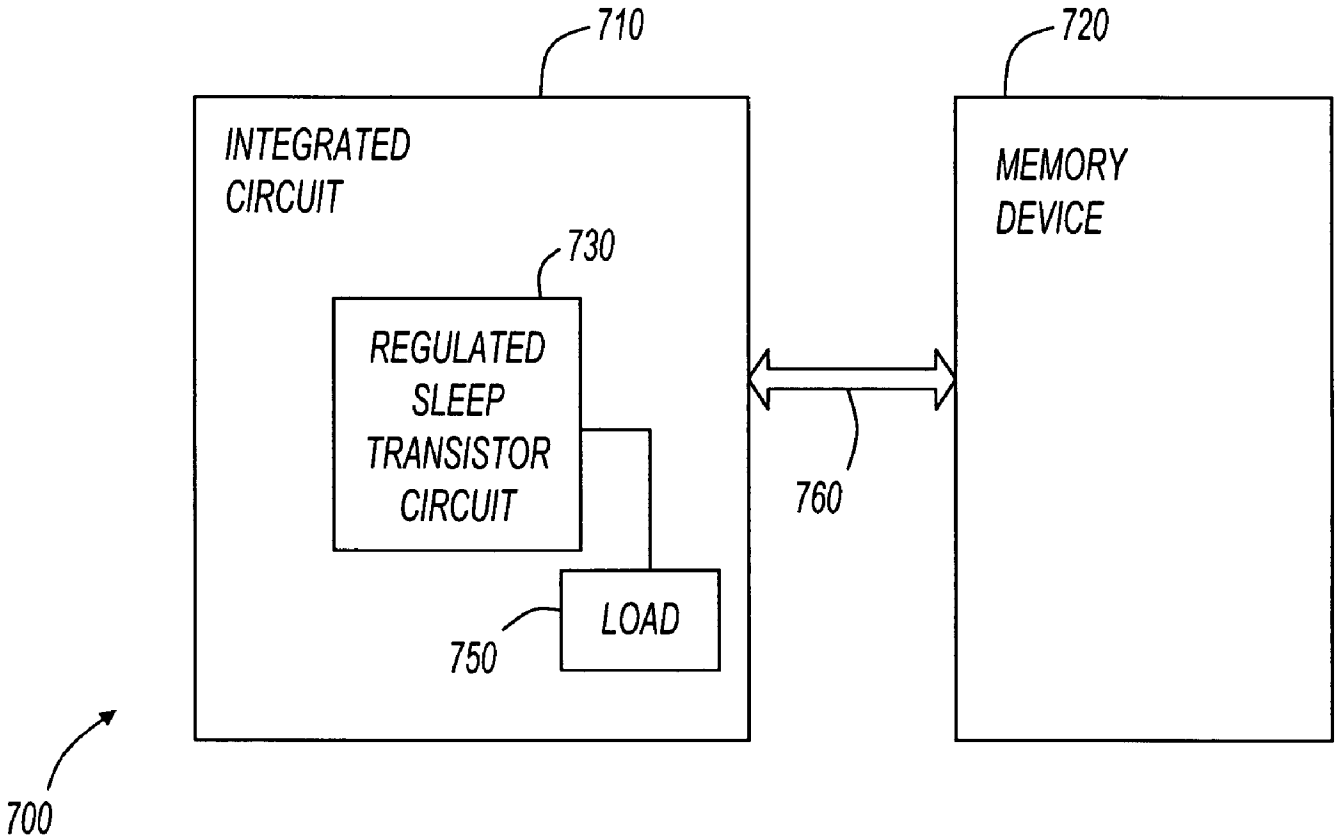
FIG. 7 shows a system diagram in accordance with various embodiments of the present invention.

FIG. 7 shows a system diagram in accordance with various embodiments of the present invention. Electronic system 700 includes integrated circuit 710 and memory device 720 interconnected by conductor 760. Integrated circuit 710 includes regulated sleep transistor circuit 730 and load circuit 750. Integrated circuit 710 may be any type of integrated circuit adapted to communicate with memory device 720. For example, integrated circuit 710 may be a microprocessor, a digital signal processor, a microcontroller, an application specific integrated circuit (ASIC), a memory controller, or the like. In some embodiments, memory device 720 may include a dynamic random access memory (DRAM) or a static random access memory (SRAM).

Regulated sleep transistor circuit 730 may be any of the embodiments disclosed herein. For example, regulated sleep transistor circuit 730 may include a transistor coupled to a power supply node, the operation of which is influenced by a control circuit. The control circuit may include one or more feedback loops of varying bandwidth. A first control loop may include an error amplifier and a multiplexer, and a second control loop may include a fast loop feedback circuit.

In some embodiments, integrated circuit 710 includes a microprocessor, and load circuit 750 includes a cache memory circuit. The cache memory circuit may operate at a power supply voltage provided by regulated sleep transistor circuit 730 through power supply regulation. Power supply regulation may be provided on one or more power supply nodes. For example, a first regulated voltage may be provided from a first power supply node, and a second regulated voltage may be provided from a second power supply node. The number of regulated power supply voltages is not limited by the present invention.

In some embodiments, integrated circuit 710 and memory device 720 may be separately packaged and mounted on a common circuit board. Each of integrated circuit 710 and memory device 720 may also be separately packaged and mounted on separate circuit boards interconnected by conductor 760. In other embodiments, integrated circuit 710 and memory device 720 are separate integrated circuit dice packaged together, such as in a multi-chip module, and in still further embodiments, integrated circuit 710 and memory device 720 are on the same integrated circuit die.

The type of interconnection between integrated circuit 710 and memory device 720 is not a limitation of the present invention. For example, conductor 760 may be a serial interface, a test interface, a parallel interface, or any other type of interface capable of transferring information between integrated circuit 710 and memory device 720.

Integrated circuits, regulated sleep transistor circuits, load circuits, fast loop feedback circuits, memory devices, and other embodiments of the present invention can be implemented in many ways. In some embodiments, they are implemented in integrated circuits. In some embodiments, design descriptions of the various embodiments of the present invention are included in libraries that enable designers to include them in custom or semi-custom designs. For example, any of the disclosed embodiments can be implemented in a synthesizable hardware design language, such as VHDL or Verilog, and distributed to designers for inclusion in standard cell designs, gate arrays, or the like. Likewise, any embodiment of the present invention can also be represented as a hard macro targeted to a specific manufacturing process. For example, fast loop feedback circuit 502 (FIG. 5) may be represented as polygons assigned to layers of an integrated circuit.

Figure 8:
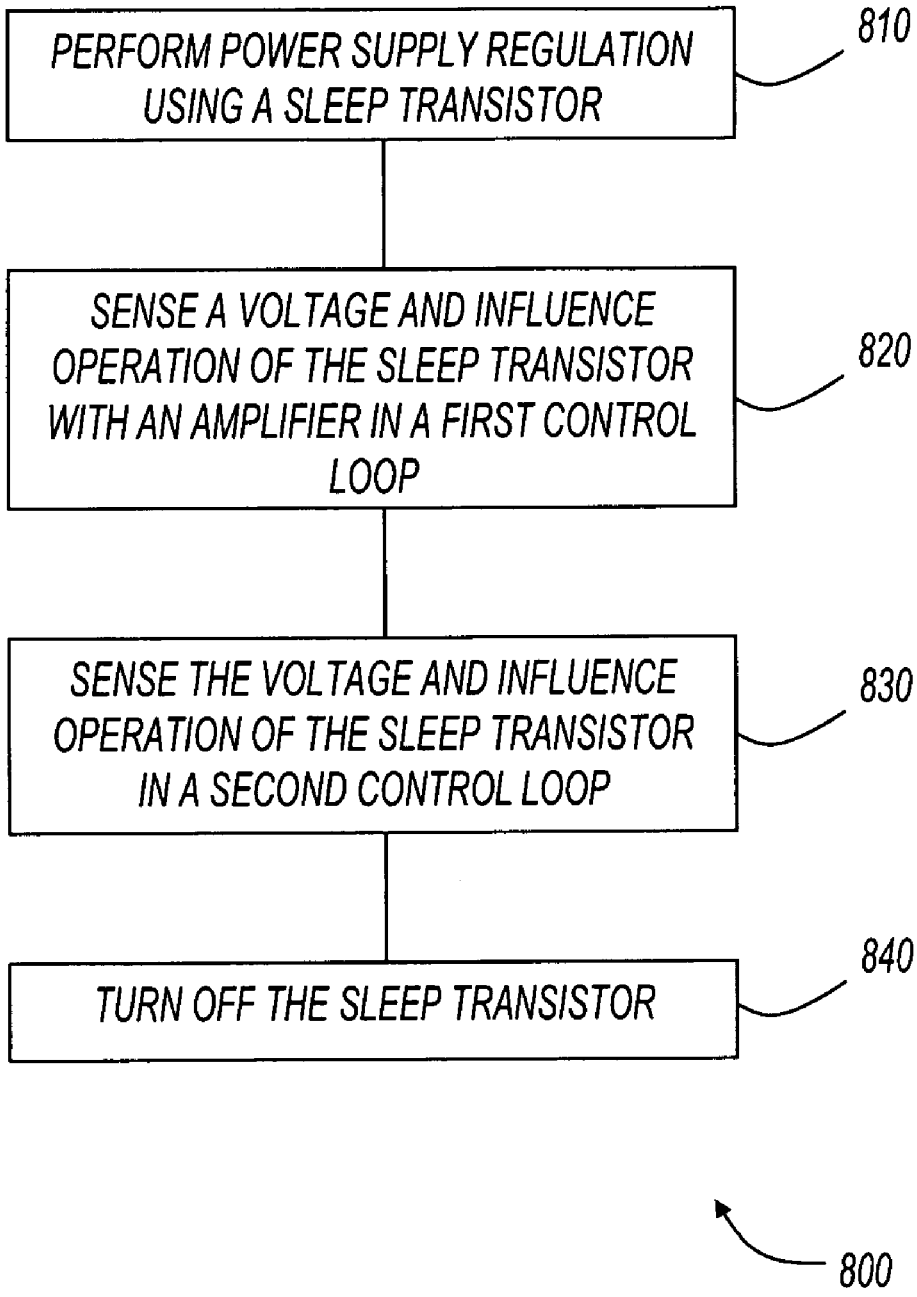
FIG. 8 shows a flowchart in accordance with various embodiments of the present invention.

FIG. 8 shows a flowchart in accordance with various embodiments of the present invention. In some embodiments, method 800, or portions thereof, is performed by a regulated sleep transistor circuit, embodiments of which are shown in previous figures. In other embodiments, method 800 is performed by a control circuit, an integrated circuit, or an electronic system. Method 800 is not limited by the particular type of apparatus performing the method. The various actions in method 800 may be performed in the order presented, or may be performed in a different order. Further, in some embodiments, some actions listed in FIG. 8 are omitted from method 800.

Method 800 is shown beginning with block 810 in which power supply regulation is performed using a sleep transistor. In some embodiments, this may correspond to one or both of transistors 110 and 210 (previous figures) providing power supply regulation. At 820, a voltage is sensed, and the operation of the sleep transistor is influenced with an amplifier in a first control loop. In some embodiments, the actions listed in 820 may correspond to error amplifier 120 (FIG. 1) sensing the voltage on node 116, and influencing the operation of transistor 110. In other embodiments, the actions listed in 820 may correspond to error amplifier 220 (FIG. 2) sensing the voltage on node 216, and influencing the operation of transistor 210.

At 830, the voltage is sensed and the operation of the transistor is influenced in a second control loop. In some embodiments, the second control loop operates at a higher bandwidth than the first control loop. For example, the second control loop may include one or more fast loop feedback circuits such as circuits 502 (FIG. 5) or 602 (FIG. 6).

At 840, the sleep transistor is turned off. In some embodiments, the sleep transistor may be coupled between a power supply node and a load circuit, and turning the sleep transistor off reduces leakage current. For example, referring now back to FIG. 2, if either of transistors 110 or 120 is turned off, the leakage current of load circuit 150 may be reduced.

Figure 9:
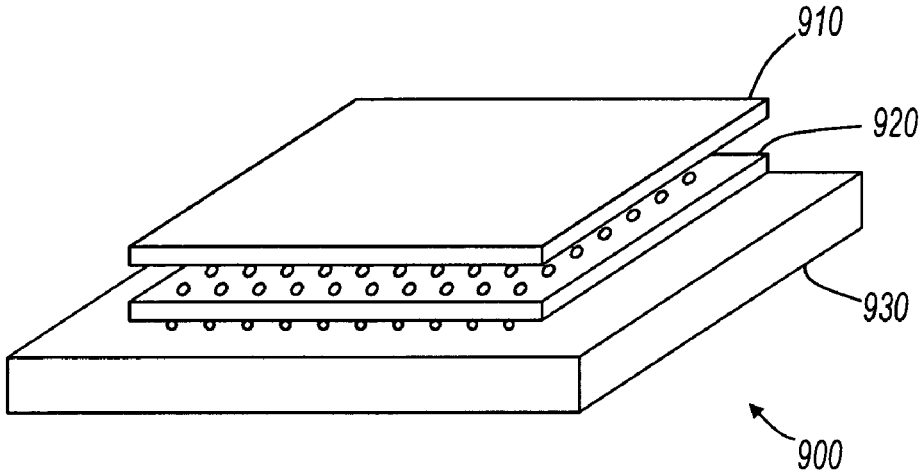
FIG. 9 shows an exploded isometric view of stacked integrated circuit dice.

FIG. 9 shows an exploded isometric view of stacked integrated circuit dice. Stack 900 includes integrated circuit die (IC) 910, integrated circuit die (IC) 920, and package 930. In some embodiments, IC 910 includes load devices such as load 150 (FIG. 1). Also in some embodiments, IC 920 includes regulated sleep transistors and loop circuits to control them. For example, referring to FIG. 2, IC 920 may include circuits such as amplifiers 120 and 220, fast loop feedback circuits 310 and 410, multiplexers 130 and 230, and regulated sleep transistors 110 and 210.

Integrated circuit die 910 may be an integrated circuit die that does not include regulated sleep transistors. By combining ICs 910 and 920, regulated sleep transistors may be added to existing load circuits (within IC 910).

Package 930 may be any type of suitable package. For example, package 930 may include ceramic material, organic material, or any combination. Further package 930 may be part of a larger assembly, such as a multi-chip module.

Figure 10:
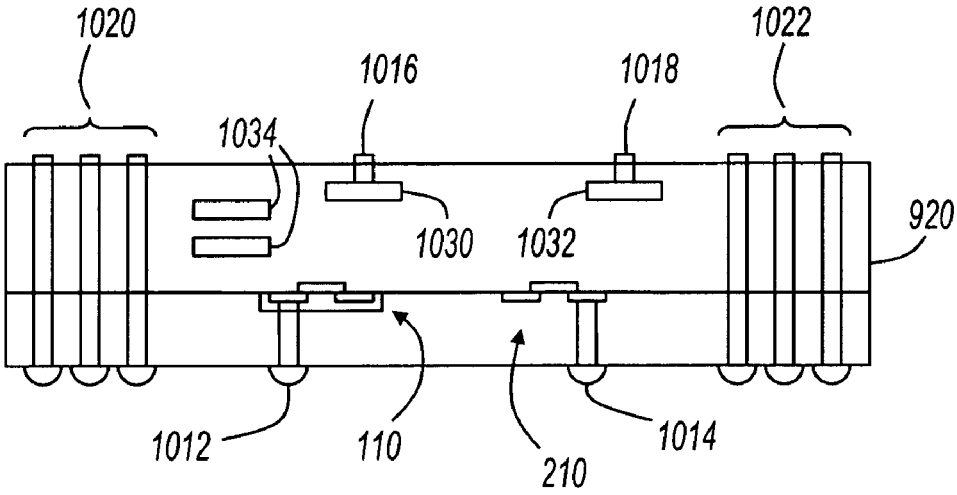
FIG. 10 shows a cross section of an integrated circuit die.

FIG. 10 shows a cross section of an integrated circuit die. Integrated circuit die 920 includes regulated sleep transistors 110 and 210. Regulated sleep transistor 110 is shown as a transistor within a well, and having one diffusion region coupled by a via to bump 1012. In some embodiments, bump 1012 corresponds to an upper power supply node such as power supply node 112 (FIG. 2). Regulated sleep transistor 210 is shown as a transistor fabricated into a substrate without a well, and having one diffusion region coupled by a via to bump 1014. In some embodiments, bump 1014 corresponds to a lower power supply node such as power supply node 114 (FIG. 2). Bumps shown on the bottom side of IC 920 may be electrically coupled to package 930 (FIG. 9).

Integrated circuit die 920 also includes metal 1030, 1032, and 1034, and regulated power supply contacts 1016 and 1018. In some embodiments, contact 1016 may correspond to node 116 (FIG. 2), and contact 1018 may correspond to node 216 (FIG. 2). Metal 1034 may form a capacitor to provide power supply decoupling between either the power supply nodes on the bottom of IC 920 or the power supply nodes on top of IC 920, or any combination. For example, metal 1034 may form a capacitor between bumps 1012 and 1014, between regulated power supply contacts 1016 and 1018, between bump 1012 and regulated power supply contact 1016, or between bump 1014 and regulated power supply contact 1018. Integrated circuit die 920 may also include circuitry corresponding to the feedback loops shown in the previous figures. The circuitry within integrated circuit die 920 may be manufactured using any process.

Integrated circuit 920 also includes input/output (I/O) vias 1020 and 1022. I/O vias 1010 and 1022 includes contacts on the top side of IC 920, and bumps on the bottom side of IC 920. The contacts on top may provide a surface to which bumps on another integrated circuit die may be coupled. For example, referring now back to FIG. 9, IC 910 may include bumps that make electrical contact with contacts on the top side of IC 920. Further, IC 910 may have power supply pins or bumps that also make contact with contacts on the top side of IC 920.

Although FIG. 10 shows two regulated sleep transistors and two regulated power supply contacts, this is not a limitation of the present invention. For example, any number of regulated sleep transistors and regulated power supply contacts may be present in IC 920. In some embodiments, some or all of the regulated sleep transistors are coupled in parallel to provide power supply regulation to an entire integrated circuit on top of IC 920. In other embodiments, many separate regulated sleep transistors and control loop circuits exist to provide power supply regulation and sleep control to separate portions of an integrated circuit on top of IC 920.

Although the present invention has been described in conjunction with certain embodiments, it is to be understood that modifications and variations may be resorted to without departing from the spirit and scope of the invention as those skilled in the art readily understand. Such modifications and variations are considered to be within the scope of the invention and the appended claims.

What is claimed is:

1. An apparatus comprising:
a power supply node;
a load circuit;
a transistor coupled between the power supply node and the load circuit; and
a control circuit to utilize the transistor as a regulator or a sleep transistor, wherein the control circuit is coupled to provide either a first signal to influence operation of the transistor as a sleep transistor or a second signal to influence operation of the transistor as a regulator, wherein the control circuit comprises a first control loop having an error amplifier, and a second control loop having a higher bandwidth that the first control loop, and wherein the second control loop is adapted to sense a voltage between the transistor and the load circuit using a source of a second transistor.

2. The apparatus of claim 1 further comprising:
a second power supply node; and
a second transistor coupled between the load circuit and the second power supply node;
wherein the control circuit is adapted to utilize the second transistor as a regulator or a sleep transistor.

3. The apparatus of claim 1 wherein the load circuit comprises a memory circuit.

4. The apparatus of claim 1 wherein the load circuit comprises a cache memory circuit.

5. A circuit comprising:
a sleep transistor coupled between a power supply node and a load circuit, wherein the sleep transistor is coupled to provide power supply regulation;
an error amplifier coupled to the sleep transistor;
a multiplexer coupled between the error amplifier and the sleep transistor, wherein the multiplexer is adapted to conditionally turn off the sleep transistor;
a first control loop that includes the error amplifier; and
a second control loop including a sensing transistor coupled to sense a voltage variation using a source terminal.

6. The circuit of claim 5 further comprising a bias transistor coupled between the sensing transistor and a second power supply node.

7. The circuit of claim 6 further comprising a voltage divider coupled between the power supply node and a node formed at a junction between the sensing transistor and bias transistor, the voltage divider to influence operation of the sleep transistor.

8. The circuit of claim 5 wherein the load circuit comprises a memory circuit.

9. The circuit of claim 5 wherein the load circuit comprises a cache memory circuit.

10. The circuit of claim 5 wherein the load circuit is in a first integrated circuit die, and the sleep transistor is in a second integrated circuit die.

11. The circuit of claim 10 wherein the first integrated circuit die is mounted on top of the second integrated circuit die.

12. A method comprising performing power supply regulation using a sleep transistor and sensing a voltage and influencing operation of the sleep transistor with an amplifier in a first control loop, and sensing the voltage with a transistor source terminal and influencing operation of the sleep transistor in a second control loop.

13. The method of claim 12 further comprising turning off the sleep transistor.

14. An electronic system comprising:

a first integrated circuit including a sleep transistor coupled between a power supply node and a load circuit, and an error amplifier coupled to the sleep transistor, the sleep transistor to provide power supply regulation, the first integrated further including a first control loop having the error amplifier, and a second control loop including a sensing transistor coupled to sense a voltage variation on the load circuit using a source terminal; and a static random access memory device coupled to the first integrated circuit.

15. The electronic system of claim 14 wherein the first integrated circuit further includes a multiplexer coupled between the error amplifier and the sleep transistor, wherein the multiplexer is adapted to conditionally turn off the sleep transistor.

16. The electronic system of claim 14 wherein the first integrated circuit further includes a control circuit to conditionally turn off the sleep transistor.

17. The method of claim 12 wherein performing power supply regulation comprises performing power supply regulation to a memory circuit.

18. An apparatus comprising:

a transistor operable to be coupled between a power supply node and a load circuit; and a control circuit to operate the transistor as a sleep transistor or a regulator, the control circuit comprising a first control loop having an error amplifier and a second control loop having a sensing transistor with a source terminal coupled to sense a voltage on the load circuit.

19. The apparatus of claim 18 further comprising a bias transistor coupled between the sensing transistor and a second power supply node.

20. The apparatus of claim 19 further comprising a voltage divider coupled between the power supply node and a node formed at a junction between the sensing transistor and bias transistor, the voltage divider to influence operation of the sleep transistor.

21. The apparatus of claim 18 further comprising:

a first integrated circuit die that includes the transistor and the control circuit; and a second integrated circuit die that includes the load circuit.

22. The apparatus of claim 21 wherein the first and second integrated circuit dice are situated one on top of the other.

23. The apparatus of claim 21 wherein the load circuit comprises a memory circuit.

24. The apparatus of claim 21 wherein the load circuit comprises a cache memory circuit.

25. The apparatus of claim 18 further comprising a second transistor operable to be coupled between the load circuit and a second power supply node, wherein the control circuit is adapted to utilize the second transistor as a regulator or a sleep transistor.

* * * * *

UNITED STATES PATENT AND TRADEMARK OFFICE

CERTIFICATE OF CORRECTION

PATENT NO. : 7,042,274 B2
APPLICATION NO. : 10/673822
DATED : May 9, 2006
INVENTOR(S) : Hazucha et al.

It is certified that error appears in the above-identified patent and that said Letters Patent is hereby corrected as shown below:

On the title page, item (56), under "U.S. Patent Documents", in column 2, line 2, delete "6,384,674 B1" and insert - - 6,384,674 B2 - -, therefor.

On the title page, item (56), under "U.S. Patent Documents", in column 2, line 3, above "6,744,301" insert - - 6,677,735 B2 1/2004 Xi 323/273 - -.

On the title page, item (56), under "U.S. Patent Documents", in column 2, line 4, delete "6,765,414 B1" and insert - - 6,765,414 B2 - -, therefor.

On the title page, item (56), under "U.S. Patent Documents", in column 2, line 4, below "6,765,414" insert - - 6,775,784 B1 8/2004 Park 713/320
6,806,690 B2 10/2004 Xi 323/273 - -.

In column 9, line 11, in Claim 14, after "integrated" insert - - circuit - -.

Signed and Sealed this

Twenty-second Day of August, 2006

JON W. DUDAS
*Director of the United States Patent and Trademark Office*